US010799944B2

(12) United States Patent
Fujito et al.

(10) Patent No.: US 10,799,944 B2
(45) Date of Patent: Oct. 13, 2020

(54) EQUIPMENT AND METHOD FOR MANUFACTURING COPPER ALLOY MATERIAL

(71) Applicant: Hitachi Metals, Ltd., Tokyo (JP)

(72) Inventors: Keisuke Fujito, Mito (JP); Shohei Hata, Mito (JP); Takayuki Tsuji, Kitaibaraki (JP); Hiromitsu Kuroda, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 359 days.

(21) Appl. No.: 15/622,374

(22) Filed: Jun. 14, 2017

(65) Prior Publication Data

US 2017/0368599 A1 Dec. 28, 2017

(30) Foreign Application Priority Data

Jun. 27, 2016 (JP) ..... 2016-126301

(51) Int. Cl.

| | |
|---|---|
| ***B22D 11/04*** | (2006.01) |
| ***B22D 11/116*** | (2006.01) |
| ***C22C 1/04*** | (2006.01) |
| ***B22D 11/00*** | (2006.01) |
| ***C22C 1/02*** | (2006.01) |
| ***C22C 1/10*** | (2006.01) |

(Continued)

(52) U.S. Cl.

CPC ..... *B22D 11/116* (2013.01); *B22D 11/004* (2013.01); *C22C 1/02* (2013.01); *C22C 1/0425* (2013.01); *C22C 1/1036* (2013.01); *C22C 9/00* (2013.01); *B21B 3/003* (2013.01); *B21B 2003/005* (2013.01)

(58) Field of Classification Search

CPC ..... B22D 11/116; B22D 11/004

See application file for complete search history.

(56) References Cited

U.S. PATENT DOCUMENTS 4,277,281 A * 7/1981 Weber ..... B22D 11/119 164/474
4,839,049 A * 6/1989 Kinney, Jr. ..... B01D 39/2075 210/510.1

FOREIGN PATENT DOCUMENTS

JP H 05-50194 A 3/1993
JP 2002-120050 A 4/2002

(Continued)

OTHER PUBLICATIONS

Japanese Office Action dated Mar. 24, 2020, in Japanese Patent Application No. 2016-126301 with an English translation.

(Continued)

*Primary Examiner* — Scott R Kastler

(74) *Attorney, Agent, or Firm* — McGinn IP Law Group, PLLC

(57) ABSTRACT

A copper alloy material manufacturing equipment for manufacturing a copper alloy material by continuously casting molten copper. The equipment includes an element adding means for adding a metal element to the molten copper, a tundish for holding the molten copper containing the metal element, a pouring nozzle connected to the tundish to feed the molten copper from the tundish, and a trapping member arranged inside the tundish and including a same type of material as at least one of an oxide of the metal element, a nitride of the metal element, a carbide of the metal element and a sulfide of the metal element.

21 Claims, 4 Drawing Sheets

(51) Int. Cl.
*C22C 9/00* (2006.01)
*B21B 3/00* (2006.01)

(56) References Cited

FOREIGN PATENT DOCUMENTS

| | | | |
|---|---|---|---|
| JP | 3552043 | B2 | 8/2004 |
| JP | 2008-260021 | | 10/2008 |

OTHER PUBLICATIONS

Chinese Office Action dated Mar. 19, 2020, in Chinese Patent Application No. 201710468482.7 with an English translation.

* cited by examiner

EQUIPMENT AND METHOD FOR MANUFACTURING COPPER ALLOY MATERIAL

The present application is based on Japanese patent application No. 2016-126301 filed on Jun. 27, 2016, the entire contents of which are incorporated herein by reference.

BACKGROUND OF THE INVENTION

1. Field of the Invention

The invention relates to an equipment and method for manufacturing a copper alloy material.

2. Description of the Related Art

As a method of manufacturing a copper alloy material, for example, a continuous casting and rolling method is known. In this method, firstly, molten copper is formed by melting a copper material in a smelting furnace. Next, a metal element (alloying element) such as titanium or magnesium is added to the molten copper. Next, the molten copper containing the alloying element is transferred to a tundish, and the molten copper in the tundish is fed to a continuous casting machine through a pouring nozzle. After that, the molten copper is rolled by the continuous casting machine while being cooled and solidified, thereby obtaining a copper alloy material (see e.g. JP-B-3552043).

SUMMARY OF THE INVENTION

As a result of a study by the inventors, it was found that when molten copper containing an inclusion consisting of an oxide, etc., of an alloying element is fed from a tundish through a pouring nozzle, the inclusion sticks to the pouring nozzle which is thereby blocked. Since this requires removal of the blockage in the pouring nozzle, it is difficult to continuously operate the copper alloy manufacturing machine for long periods of time and thus difficult to manufacture a copper alloy material at high productivity.

It is an object of the invention to provide an equipment and method for manufacturing a copper alloy material that can reduce the blockage of the pouring nozzle caused by the sticking of inclusions contained in molten copper to the pouring nozzle during manufacturing of the copper alloy material.

According to an embodiment of the invention, a copper alloy material manufacturing equipment for manufacturing a copper alloy material by continuously casting molten copper, the equipment comprises:

an element adding means for adding a metal element to the molten copper;

a tundish for holding the molten copper containing the metal element;

a pouring nozzle connected to the tundish to feed the molten copper from the tundish; and a trapping member arranged inside the tundish and comprising a same type of material as at least one of an oxide of the metal element, a nitride of the metal element, a carbide of the metal element and a sulfide of the metal element.

According to another embodiment of the invention, a method of manufacturing a copper alloy material comprises:

adding a metal element to molten copper;

holding the molten copper containing the metal element in a tundish;

trapping inclusions by a trapping member arranged inside the tundish and comprising a same type of material as the inclusions, the inclusions being contained in the molten metal and comprising at least one of an oxide of the metal element, a nitride of the metal element, a carbide of the metal element and a sulfide of the metal element; and discharging the molten copper from the tundish through a pouring nozzle.

Effects of the Invention

According to an embodiment of the invention, an equipment and method for manufacturing a copper alloy material can be provided that can reduce the blockage of the pouring nozzle caused by the sticking of inclusions contained in molten copper to the pouring nozzle during manufacturing of the copper alloy material.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Copper Alloy Material Manufacturing Equipment

Figure 1:
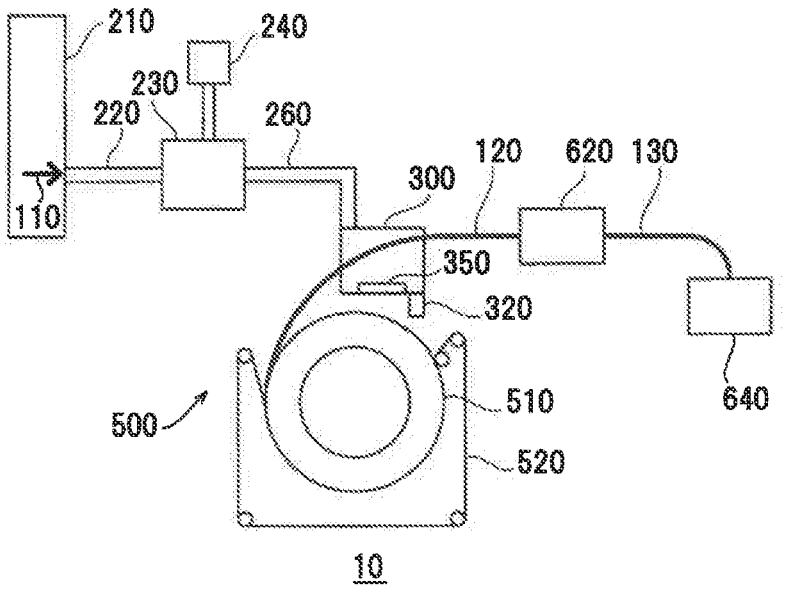
FIG. 1 is a schematic configuration diagram illustrating a copper alloy material manufacturing equipment in an embodiment of the present invention.

A copper alloy material manufacturing equipment in an embodiment of the invention will be described in reference to FIG. 1, FIG. 1 is a schematic configuration diagram illustrating a copper alloy material manufacturing equipment in the present embodiment.

The term "copper alloy material" as used herein is a collective term for wire rod and wire strand obtained by drawing the wire rod.

As shown in FIG. 1, a copper alloy material manufacturing equipment 10 in the present embodiment is configured as so-called continuous casting-and-rolling system (Southwire Continuous Rod system: SCR) for continuously casting and rolling a copper alloy material, and has, e.g., a smelting furnace 210, an upper pipe 220, a retaining furnace 230, an element adding means 240, a lower pipe 260, a tundish 300, a pouring nozzle 320, a continuous casting machine 500, a continuous rolling mill 620 and a coiler 640.

The smelting furnace 210 is configured to heat and melt a copper raw material to produce molten copper 110, and has a furnace main body and a burner provided at a lower portion of the furnace main body. The copper raw material introduced into the furnace main body is heated by the burner and the molten copper 110 is continuously produced. The copper raw material which can be used here is, e.g., electrolytic copper (Cu), etc.

The upper pipe 220 is provided downstream of the smelling furnace 210 so as to connect the smelting furnace 210 to the retaining furnace 230, and is configured to transfer the molten copper 110 produced in the smelting furnace 210 to the downstream retaining furnace 230.

The retaining furnace 230 is provided downstream of the upper pipe 220 and is configured to (temporarily) hold the molten copper 110 transferred through the upper pipe 220 while heating at a predetermined temperature. The retaining furnace 230 is also configured to transfer a predetermined amount of the molten copper 110 to the lower pipe 260 while maintaining the molten copper 110 at the predetermined temperature.

The element adding means 240 is connected to the retaining furnace 230. The element adding means 240 is configured to continuously add a predetermined metal element to the molten copper 110 in the retaining furnace 230. Examples of the metal element added to the molten copper 110 include tin (Sn), titanium (Ti), magnesium (Mg), aluminum (Al), calcium (Ca) and manganese (Mn), etc. That is, preferably, at least one of these metal elements is added to the molten copper 110. Hereinafter, the metal element added to the molten copper 110 is sometimes referred to as alloying element. The method of adding the alloying element is not specifically limited, and it is possible to use, e.g., wire injection process in which a wire formed of the alloying element is introduced into the molten copper 110.

The lower pipe 260 is provided downstream of the retaining furnace 230, and is configured to transfer the molten copper 110 from the retaining furnace 230 to the downstream tundish 300.

The element adding means 240 is not limited to the form configured to be connected to the retaining furnace 230. The element adding means 240 may be configured to be connected to, e.g., the lower pipe 260 or to the tundish 300.

The tundish 300 is provided downstream of the lower pipe 260, and is configured to (temporarily) hold the molten copper 110 transferred through the lower pipe 260 and then to continuously supply a predetermined amount of the molten copper 110 to the continuous casting machine 500. Trapping members 350 are arranged inside the tundish 300.

The pouring nozzle 320 for discharging the molten copper 110 to be held is connected to the tundish 300 on the downstream side. The pouring nozzle 320 is formed of, e.g., a refractory material such as silicon oxide, silicon carbide or silicon nitride. The molten copper 110 accumulated in the tundish 300 is supplied to the continuous casting machine 500 through the pouring nozzle 320. A flow control pin 310 (see FIG. 2) as a flow control member is provided in the vicinity of an opening of the pouring nozzle 320 to control the flow rate of the molten copper 110 which is fed through the pouring nozzle 320.

The continuous casting machine 500 is configured to perform wheel-and-belt continuous casting, and has, e.g., a wheel (or ring) 510 and a belt 520. The cylindrical wheel 510 has a groove on the outer peripheral surface. Meanwhile, the belt 520 is configured to rotate while being in contact with a portion of the outer peripheral surface of the wheel 510. The molten copper 110 fed from the tundish 300 is poured into a space formed between the groove of the wheel 510 and the belt 520. The wheel 510 and the belt 520 are cooled by, e.g., cooling water. As such, the molten copper 110 is cooled and solidified (becomes solid), thereby continuously forming a bar-shaped cast material 120.

The continuous rolling mill 620 is provided downstream (on the cast material exit side) of the continuous casting machine 500, and is configured to continuously roll the cast material 120 transferred from the continuous casting machine 500. The cast material 120 is rolled into a copper alloy material 130 such as wire rod or wire strand having a predetermined outer diameter.

The coiler 640 is provided downstream (on the copper alloy material exit side) of the continuous rolling mill 620, and is configured to take up the copper alloy material 130 transferred from the continuous rolling mill 620.

As mentioned above, inclusions contained the molten copper 110 stick to the pouring nozzle 320 of the tundish 300 and the pouring nozzle 320 is thereby sometimes blocked. The inventors considered that the inclusion contained the molten copper 110 needs to be removed before the molten copper 110 is introduced into the pouring nozzle 320, and such method was studied.

Inclusions contained the molten copper 110 are, e.g., oxide, nitride, carbide and sulfide of the alloying element. In other words, the inclusions are formed of at least one of an oxide of the alloying element, a nitride of the alloying element, a carbide of the alloying element and a sulfide of the alloying element. Among the inclusions produced, the amount of the oxide of the alloying element is particularly large.

Inclusions in the form of large agglomerated grain come up to the surface of the molten copper 110 and thus can be collected and removed from the melt surface. On the other hand, inclusions, which are not agglomerated and have a small grain size, do not come up to the melt surface, thus flow out through the pouring nozzle 320 while still being contained in the molten copper 110 and are mixed to a casting.

However, the non-agglomerated inclusions with a small grain size are considered to be in a state of easily agglomerating together. In addition, agglomeration of the inclusions is enhanced when having low wettability with the molten copper 110, and it is considered that the inclusions when formed of the same type of material are especially likely to agglomerate together. Here, "the same type" of material or properties means that an oxide of an alloying element is the same type as an oxide of the alloying element, a nitride of an alloying element is the same type as a nitride of the alloying element, a carbide of an alloying element is the same type as a carbide of the alloying element, and a sulfide of an alloying element is the same type as a sulfide of the alloying element. For example, the same type of material as a titanium oxide is a titanium oxide.

Based on such knowledge, the inventors found that when the tapping member 350 formed of the same type of material as the inclusions is arranged inside the tundish 300 so as to come into contact with the molten copper 110 containing the inclusions, the inclusions can be trapped by (deposited on) the trapping member 350 and the inclusions in the molten copper 110 thereby can be removed (reduced).

By trapping and collecting the inclusions using the trapping member 350, it is possible to prevent blockage of the pouring nozzle 320 due to the sticking of the inclusions.

Figure 2:
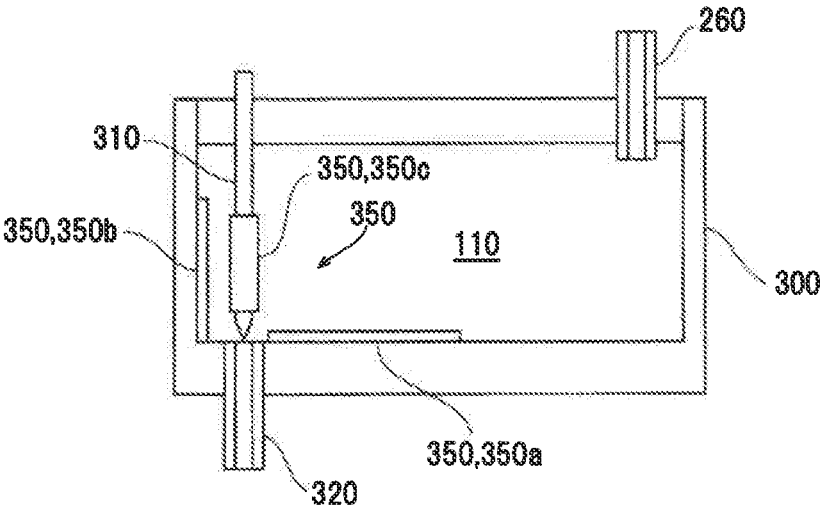
FIG. 2 is an enlarged schematic configuration diagram illustrating a tundish and the vicinity thereof.
Figure 3A:
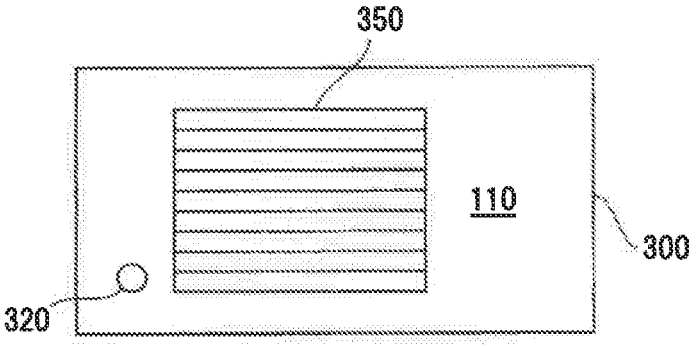
FIGS. 3A and 3B are respectively a schematic upper view and a schematic cross-sectional view showing an example of the structure of a trapping member.
Figure 3B:
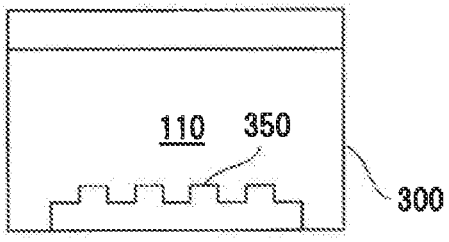
Figure 4A:
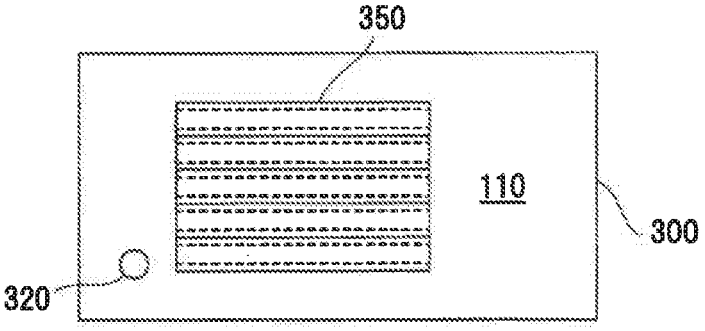
FIGS. 4A and 4B are respectively a schematic upper view and a schematic cross-sectional view showing another example of the structure of the trapping member.
Figure 4B:
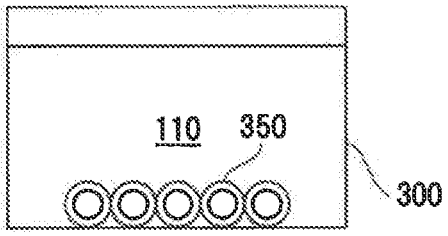

Next, the trapping member 350 in the present embodiment will be described in more detail in reference to FIGS. 2 to 4B. FIG. 2 is an enlarged schematic diagram illustrating the tundish 300 and the vicinity thereof. FIGS. 3A and 3B are schematic diagrams showing an example of the structure of the trapping member 350, and FIGS. 4A and 4B are schematic diagrams showing another example of the structure of the trapping member 350.

As shown in FIG. 2, inside the tundish 300, the molten copper 110 flows in through the supply port of the lower pipe 260 and flows out through the pouring nozzle 320 which is connected to the bottom of the tundish 300. That is, the molten copper 110 flows from the supply port of the lower pipe 260 toward the pouring nozzle 320.

The flow control pin 310 is provided as a flow control member so as to face the pouring nozzle 320 (so as to face the opening of the pouring nozzle 320). To control the flow rate of the molten copper 110, the effective opening area allowing the molten copper 110 to pass through is changed by adjusting a distance between the opening of the pouring nozzle 320 and a tip portion of the flow control pin 310 which faces the opening of the pouring nozzle 320.

The trapping member 350 is preferably arranged at a position at which deposition of the inclusions causes an operational problem, i.e., a position which is upstream of the molten copper 110 and at which the cross sectional area of the flow of the molten copper 110 is sufficiently wide (e.g., not less than 10 times the opening of the pouring nozzle 320) without covering the opening.

The trapping member 350 is preferably arranged on at least one of, e.g., the inner wall surface of the tundish 300 and a surface of the flow control pin 310. In such a configuration, the inclusions contained in the molten copper 110 flowing from the supply port of the lower pipe 260 toward the pouring nozzle 320 are trapped and collected by the trapping member 350. FIG. 2 shows an example in which trapping members 350*a* and 350*b* are respectively arranged on the bottom surface and side surface of the tundish 300 and a trapping member 350*c* is arranged on the surface of the flow control pin 310 at a position slightly above the tip portion.

The trapping member 350 is not limited to a separate component from the tundish 300 or the flow control pin 310. The trapping member 350 may be configured as at least a portion of the surface of the tundish 300 or the flow control pin 310.

In view of increasing sticking performance of the inclusions, the trapping member 350 preferably has a structure which provides a larger area available for contact with the inclusions, i.e., a larger contact area with the molten copper 110.

For example, by providing concave-convex portions on a surface of the trapping member 350 as shown in FIGS. 3A and 3B, it is possible to increase a contact area with the inclusions (as compared to when the trapping member 350 has, e.g., a flat plate shape). FIGS. 3A and 3B are respectively a schematic upper view and a schematic cross-sectional view (orthogonal to an extending direction of the grooves) showing the trapping member 350.

The concave-convex portions on the trapping member 350 can be, e.g., grooves extending such that one end is located closer to the opening of the pouring nozzle 320 and the other end is located far from the opening. By providing such grooves on the trapping member 350, it is possible to increase the contact area with the inclusions while at the same time preventing flow turbulence of the molten copper 110 which travels toward the opening of the pouring nozzle 320 in the tundish 300. Although the trapping member 350 arranged on the bottom surface of the tundish 300 is shown as an example in FIGS. 3A and 3B, the trapping members 350 arranged on the other positions may have the structure with concave-convex portions in the same manner.

Alternatively, by providing the trapping member 350 with a tubular shape as shown in FIGS. 4A and 4B, it is possible to increase the contact area with the inclusions (as compared to when the trapping member 350 has, e.g., a flat plate shape). In this case, it is possible to trap the inclusions on both the inner and outer surfaces of the tubes. FIGS. 4A and 4B are respectively a schematic upper view and a schematic cross-sectional view (orthogonal to an extending direction of the tubes) showing the trapping member 350.

The tubular shape of the trapping member 350 can be, e.g., tubes extending such that one end is located closer to the opening of the pouring nozzle 320 and the other end is located far from the opening. By providing the trapping member 350 with such tubes, it is possible to increase the contact area with the inclusions while at the same time preventing flow turbulence of the molten copper 110 which travels toward the opening of the pouring nozzle 320 in the tundish 300. Although the trapping member 350 arranged on the bottom surface of the tundish 300 is shown as an example in FIGS. 4A and 4B, the trapping members 350 arranged on the other positions may have a shape with tubes in the same manner.

The trapping member 350 is preferably formed of the same type of material as the inclusions contained in the molten copper 110, i.e., the same type of material as at least one of an oxide of the alloying element, a nitride of the alloying element, a carbide of the alloying element and a sulfide of the alloying element.

The element added as the alloying element is preferably at least one of, e.g., tin titanium, magnesium, aluminum, calcium and manganese, as described above.

When tin is added as the alloying element, the trapping member 350 is preferably formed of at least one of a tin oxide, a tin nitride, a tin carbide and a tin sulfide.

When titanium is added as the alloying element, the trapping member 350 is preferably formed of at least one of a titanium oxide, a titanium nitride, a titanium carbide and a titanium sulfide.

When magnesium is added as the alloying element, the trapping member 350 is preferably formed of at least one of a magnesium oxide, a magnesium nitride, a magnesium carbide and a magnesium sulfide.

When aluminum is added as the alloying element, the trapping member 350 is preferably formed of at least one of an aluminum oxide, an aluminum nitride, an aluminum carbide and an aluminum sulfide.

When calcium is added as the alloying element, the trapping member 350 is preferably formed of at least one of a calcium oxide, a calcium nitride, a calcium carbide and a calcium sulfide.

When manganese is added as the alloying element, the trapping member 350 is preferably formed of at least one of a manganese oxide, a manganese nitride, a manganese carbide and a manganese sulfide.

The oxide of the alloying element is particularly likely to be produced as the inclusion. Therefore, it is particularly preferable that the trapping member 350 be formed of at least the same type of material as the oxide of the alloying element.

Complete removal of the inclusions from the molten copper 110 is not necessary as long as it is removed (reduced) to the extent that the pouring nozzle 320 is not blocked or the residual inclusions in the copper alloy material do not cause a decrease in quality.

When adding titanium as an alloying element, it is possible to control crystal grain size by leaving an appropriate amount of titanium oxide in the molten copper 110 (in the copper alloy material), and this is advantageous in that, e.g., it is possible to control softness, elongation characteristics and flexing characteristics of the copper alloy material. For this reason, titanium is particularly preferable as the alloying element to be added, and accordingly, it is particularly preferable to use a titanium oxide to form the trapping member 350.

The trapping member 350 arranged inside the tundish 300 does not need to be entirely formed of a single material. It is possible to use, if required, not less than two types (i.e., plural types) of materials to form the trapping member 350. In other words, the trapping member 350 may be formed of at least a first material and a second material, where the first material is the same type of material as a first substance among an oxide of the alloying element, a nitride of the alloying element, a carbide of the alloying element and a sulfide of the alloying element, and the second material is the same type of material as a second substance (different from the first substance). In this case, inclusions corresponding to the respective materials, i.e., plural types of inclusions can be trapped by the trapping member 350. For example, when the entire trapping member 350 is composed of plural structure, each structure may be formed of a different material. In addition, for example, one structure may be formed of plural materials. In a specific example, it is possible to trap both a titanium oxide inclusion and a titanium sulfide inclusion by using the trapping member 350 formed of a titanium oxide and a titanium sulfide.

The embodiment of the trapping member 350 formed of plural materials is applicable when adding not less than two types (i.e., plural types) of alloying elements. That is, the configuration may be such that not less than two types of alloying elements include a first alloying element and a second alloying element, where the first alloying element is one of tin, titanium, magnesium, aluminum, calcium and manganese, and the second alloying element is one on those but different from the first alloying element, and the trapping member 350 is formed of at least a first material and a second material, where the first material is the same type of material as at least one of an oxide of the first alloying element, a nitride of the first alloying element, a carbide of the first alloying element and a sulfide of the first alloying element, and the second material is the same type of material as at least one of an oxide of the second alloying element, a nitride of the second alloying element, a carbide of the second alloying element and a sulfide of the second alloying element. In a specific example, it is possible to trap both a titanium oxide inclusion and a magnesium oxide inclusion by using the trapping member 350 formed of a titanium oxide and a magnesium oxide.

Method of Manufacturing Copper Alloy Material

Next, a method of manufacturing a copper alloy material using the copper alloy material manufacturing equipment 10 will be described.

The method of manufacturing a copper alloy material in the present embodiment includes a melting step, an element adding step, a tundish-filling step, an inclusion trapping step, a molten copper discharging step, a continuous casting step and a continuous rolling step. These steps are continuously performed as a series of steps, not performed separately and non-continuously.

Melting Step

Firstly, a copper material is introduced into the furnace main body of the smelting furnace 210. For example, electrolytic copper is introduced as the copper material into the smelting furnace 210 which is heated to not less than 1100° C. and not more than 1320° C. Then, the furnace main body is heated by the burner. The molten copper 110 is thereby continuously produced.

Element Adding Step

Next, the molten copper 110 produced in the smelting furnace 210 is transferred through the upper pipe 220 to the retaining furnace 230 which is maintained at a predetermined temperature. Meanwhile, a predetermined alloying element is continuously added to the molten copper 110 in the retaining furnace 230 from the element adding means 240. At this stage, inclusions (e.g., an oxide, a nitride, a carbide and a sulfide of titanium or magnesium) containing the alloying element (e.g., titanium or magnesium) are produced in the molten copper 110.

Tundish-Filling Step

Next, the molten copper 110 containing the alloying element (the inclusions) is transferred to the tundish 300 from the retaining furnace 230 through the lower pipe 260. Accordingly, the molten copper 110 is (temporarily) held in the tundish 300.

Inclusion Trapping Step

In the present embodiment, since the trapping members 350 are arranged inside the tundish 300, the inclusions are trapped and collected by the trapping members 350 while the molten copper 110 is flowing toward the pouring nozzle 320.

Molten Copper Discharging Step

Next, the molten copper 110 is fed to the continuous casting machine 500 from the tundish 300 through the pouring nozzle 320. In the present embodiment, since the inclusions are collected inside the tundish 300, it is possible to prevent the inclusions from sticking to and blocking the pouring nozzle 320 when the molten copper 110 is fed through the pouring nozzle 320.

Continuous Casting Step

Next, the molten copper 110 fed from the tundish 300 through the pouring nozzle 320 is poured into a space formed between the groove on the wheel 510 and the belt 520 in the continuous casting machine 500. Then, the belt 520 is rotated while being in contact with a portion of the outer peripheral surface of the wheel 510. At this time, the wheel 510 and the belt 520 are cooled by cooling water. This cools and solidifies the molten copper 110, thereby continuously forming the bar-shaped cast material 120.

Continuous Rolling Step

Next, the cast material 120 transferred from the continuous casting machine 500 is continuously rolled by the continuous rolling mill 620 at a temperature of, e.g., not less than 550° C. and not more than 80° C. The cast material 120 is thus processed into the copper alloy material 130, e.g., a wire rod having a predetermined outer diameter. Then, the wire rod transferred from the continuous rolling mill 620 is taken up on the coder 640. The copper alloy material 130 may be processed into a wire strand with a smaller outer diameter by further hot-rolling or cold-rolling the wire rod.

The copper alloy material 130 is manufactured through these steps.

In the present embodiment, it is possible to prevent blockage of the pouring nozzle 320 by trapping and collecting the inclusions contained in the molten copper 110 using the trapping members 350 arranged inside the tundish 300. This allows for continuous manufacturing of the copper alloy material 130 for long periods of time, and it is thus possible to manufacture the copper alloy material 130 at high productivity.

In addition, in the present embodiment, since the pouring nozzle 320 can be kept in a state that only few inclusions are sticking thereto, it is possible to reduce the amount of the inclusions mixed to the copper alloy material 130 which thus can have improved quality.

Although the invention has been described in reference to the embodiment, the invention is not limited thereto and various changes, modifications and combinations, etc., can be made.

Preferred Embodiments of the Invention

Preferred embodiments of the invention will be described below.

[1] An embodiment of the invention provides a copper alloy material manufacturing equipment for manufacturing a copper alloy material by continuously casting molten copper, the equipment comprising: an element adding means for adding a metal element to the molten copper; a tundish for holding the molten copper containing the metal element; a pouring nozzle connected to the tundish to discharge the molten copper from the tundish; and a trapping member arranged inside the tundish and comprising a same type of material as at least one of an oxide of the metal element, a nitride of the metal element, a carbide of the metal element and a sulfide of the metal element.

[2] In the copper alloy material manufacturing equipment in [1], preferably, the metal element comprises a tin, and the trapping member comprises at least one of a tin oxide, a tin nitride, a tin carbide and a tin sulfide.

[3] In the copper alloy material manufacturing equipment in [1], preferably, the metal element comprises a titanium, and the trapping member comprises at least one of a titanium oxide, a titanium nitride, a titanium carbide and a titanium sulfide.

[4] In the copper alloy material manufacturing equipment in [1], preferably, the metal element comprises a magnesium, and the trapping member comprises at least one of a magnesium oxide, a magnesium nitride, a magnesium carbide and a magnesium sulfide.

[5] In the copper alloy material manufacturing equipment in [1], preferably, the metal element comprises an aluminum, and the trapping member comprises at least one of an aluminum oxide, an aluminum nitride, an aluminum carbide and an aluminum sulfide.

[6] In the copper alloy material manufacturing equipment in [1], preferably, the metal element comprises a calcium, and the trapping member comprises at least one of a calcium oxide, a calcium nitride, a calcium carbide and a calcium sulfide.

[7] In the copper alloy material manufacturing equipment in [1], preferably, the metal element comprises a manganese, and the trapping member comprises at least one of a manganese oxide, a manganese nitride, a manganese carbide and a manganese sulfide.

[8] In the copper alloy material manufacturing equipment in [1], preferably, the trapping member comprises at least a first material and a second material, where the first Material is a same type of material as a first substance among an oxide of the metal element, a nitride of the metal element, a carbide of the metal element and a sulfide of the metal element, and the second material is the same type of material as a second substance.

[9] In the copper alloy material manufacturing equipment in [1], preferably, the metal element comprises a first metal element and a second metal element among a tin, a titanium, a magnesium, an aluminum, a calcium and a manganese, and the trapping member comprises at least a first material and a second material, where the first material is a same type of material as at least one of an oxide of the first metal element, a nitride of the first metal element, a carbide of the first metal element and a sulfide of the first metal element, and the second material is a same type of material at least as one of an oxide of the second metal element, a nitride of the second metal element, a carbide of the second metal element and a sulfide of the second metal element.

[10] In the copper alloy material manufacturing equipment in any one of [1] to [9], preferably, the trapping member is arranged on at least one of an inner wall surface of the tundish and a surface of a flow control member arranged to face the pouring nozzle.

[11] In the copper alloy material manufacturing equipment in any one of [1] to [10], preferably, the trapping member comprises a concave-convex portion on a surface.

[12] In the copper alloy material manufacturing equipment in any one of [1] to [11], preferably, the trapping member comprises a groove or a tube extending such that one end is located closer to an opening of the pouring nozzle and another end is located farther from the opening.

[13] Another embodiment of the invention provides a method of manufacturing a copper alloy material, comprising: adding a metal element to molten copper; holding the molten copper containing the metal element in a tundish; trapping inclusions by a trapping member arranged inside the tundish and comprising a same type of material as the inclusions, the inclusions being contained in the molten metal and comprising at least one of an oxide of the metal element, a nitride of the metal element, a carbide of the metal element and a sulfide of the metal element; and discharging the molten copper from the tundish through a pouring nozzle.

What is claimed is:

1. A copper alloy material manufacturing equipment for manufacturing a copper alloy material by continuously casting molten copper, the equipment comprising:

an element adding means for adding a metal element to the molten copper;

a tundish for holding the molten copper containing the metal element;

a pouring nozzle connected to the tundish to feed the molten copper from the tundish; and a trapping member arranged inside the tundish and comprising a same type of material as at least one of an oxide of the metal element, a nitride of the metal element, a carbide of the metal element and a sulfide of the metal element, wherein the trapping member comprises a groove or a pipe extending along a flowing direction of the molten copper.

2. The equipment according to claim 1, wherein the metal element comprises a tin, and the trapping member comprises at least one of a tin oxide, a tin nitride, a tin carbide and a tin sulfide, wherein the metal element comprises at least one of a tin, a titanium, a magnesium, an aluminum, a calcium and a manganese, and wherein the trapping member traps inclusions comprising the same type of material as at least one of an oxide of the metal element, a nitride of the metal element, a carbide of the metal element and a sulfide of the metal element.

3. The equipment according to claim 1, wherein the metal element comprises a titanium, and the trapping member comprises at least one of a titanium oxide, a titanium nitride, a titanium carbide and a titanium sulfide.

4. The equipment according to claim 1, wherein the metal element comprises a magnesium, and the trapping member comprises at least one of a magnesium oxide, a magnesium nitride, a magnesium carbide and a magnesium sulfide.

5. The equipment according to claim 1, wherein the metal element comprises an aluminum, and the trapping member comprises at least one of an aluminum oxide, an aluminum nitride, an aluminum carbide and an aluminum sulfide.

6. The equipment according to claim 1, wherein the metal element comprises a calcium, and the trapping member comprises at least one of a calcium oxide, a calcium nitride, a calcium carbide and a calcium sulfide.

7. The equipment according to claim 1, wherein the metal element comprises a manganese, and the trapping member comprises at least one of a manganese oxide, a manganese nitride, a manganese carbide and a manganese sulfide.

8. The equipment according to claim 1, wherein the trapping member is arranged on at least one of an inner wall surface of the tundish and a surface of a flow control member arranged to face the pouring nozzle.

9. The equipment according to claim 1, wherein the trapping member comprises a concave-convex portion on a surface.

10. The equipment according to claim 1, wherein the trapping member comprises the groove, the pipe, or a tube extending such that one end is located closer to an opening of the pouring nozzle and another end is located farther from the opening.

11. A method of manufacturing a copper alloy material, comprising:

adding a metal element to molten copper;

holding the molten copper containing the metal element in a tundish;

trapping inclusions by a trapping member arranged inside the tundish and comprising a same type of material as the inclusions, the inclusions being contained in the molten metal and comprising at least one of an oxide of the metal element, a nitride of the metal element, a carbide of the metal element and a sulfide of the metal element; and discharging the molten copper from the tundish through a pouring nozzle, wherein the trapping member comprises a groove or a pipe extending along a flowing direction of the molten copper.

12. A copper alloy material manufacturing equipment for manufacturing a copper alloy material by continuously casting molten copper, the equipment comprising:

an element adding means for adding a metal element to the molten copper;

a tundish for holding the molten copper containing the metal element;

a pouring nozzle connected to the tundish to feed the molten copper from the tundish; and a trapping member arranged inside the tundish and comprising a same type of material as at least one of an oxide of the metal element, a nitride of the metal element, a carbide of the metal element and a sulfide of the metal element, wherein the trapping member comprises a groove or a pipe extending along a flowing direction of the molten copper.

13. The equipment according to claim 12, wherein the trapping member is arranged on at least one of an inner wall surface of the tundish and a surface of a flow control member arranged to face the pouring nozzle, and wherein the trapping member comprises a concave-convex portion on a surface, or the groove, a tube, or the pipe extending such that one end is located closer to an opening of the pouring nozzle and another end is located farther from the opening.

14. The equipment according to claim 12, wherein a flow control member faces an opening of the pouring nozzle, where to control a flow rate of the molten copper, an opening area allowing the molten copper to pass through is changed by adjusting a distance between the opening of the pouring nozzle and a tip portion of the flow control member which faces the opening of the pouring nozzle, and wherein the trapping member extends along a flowing direction of the molten copper.

15. The equipment according to claim 12, wherein the trapping member is arranged along a flowing direction of the molten copper, and wherein the trapping member is arranged on at least one of an inner wall surface of the tundish and a surface of a flow control member, wherein the metal element comprises at least one of a tin, a titanium, a magnesium, an aluminum, a calcium and a manganese, and wherein the trapping member traps inclusions comprising the same type of material as at least one of an oxide of the metal element, a nitride of the metal element, a carbide of the metal element and a sulfide of the metal element.

16. The equipment according to claim 12, wherein the trapping member is arranged on at least one of a bottom surface of the tundish, side surface of the tundish, and on a surface of a flow control member at a position above a tip portion of a flow control member.

17. The equipment according to claim 13, wherein the concave-convex portion comprises a plurality of grooves extending such that one end is located closer to an opening of the pouring nozzle and the other end is located further away from the opening of the pouring nozzle.

18. The equipment according to claim 12, wherein the trapping member comprises the groove or tubular shape extending such that one end is located closer to an opening of the pouring nozzle and another end is located farther from the opening of the pouring nozzle.

19. The equipment according to claim 12, wherein the trapping member comprises a flat plate shape, tubular shape, or concave-convex shape.

20. The equipment according to claim 12, wherein the element adding means comprises an element adding device for adding a metal element to the molten copper.

21. The method according to claim 11, wherein the metal element comprises at least one of a tin, a titanium, a magnesium, an aluminum, a calcium and a manganese.

* * * * *